United States Patent [19]

Thackrey

[11] Patent Number: 4,628,161

[45] Date of Patent: Dec. 9, 1986

[54] DISTORTED-POOL MERCURY SWITCH

[76] Inventor: James D. Thackrey, 13852 Dall La., Santa Ana, Calif. 92705

[21] Appl. No.: 734,597

[22] Filed: May 15, 1985

[51] Int. Cl.[4] ..... H01H 35/02

[52] U.S. Cl. ..... 200/61.47; 200/220

[58] Field of Search ..... 200/61.47, 182, 183, 200/185, 186, 187, 188, 189, 190, 191, 192, 193, 194, 195, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, DIG. 30; 340/689

[56] References Cited

U.S. PATENT DOCUMENTS

| | | | |
|---|---|---|---|
| 2,713,159 | 7/1955 | Morrison | 340/689 |
| 3,034,097 | 3/1962 | English et al. | 200/61.47 X |
| 3,367,439 | 2/1968 | Zweben | 200/61.47 X |
| 3,599,745 | 8/1971 | Hughes | 200/61.47 X |
| 3,869,588 | 3/1975 | Ubukata et al. | 200/223 |
| 4,135,067 | 1/1979 | Bitko | 200/61.47 X |
| 4,493,066 | 1/1985 | Ubukata et al. | 200/220 X |

*Primary Examiner*—A. D. Pellinen
*Assistant Examiner*—Morris Ginsburg
*Attorney, Agent, or Firm*—James D. Thackrey

[57] ABSTRACT

A tilt switch using a conductive liquid such as mercury to bridge a gap inside the sealed switch. In operation, the pool of mercury is held in a local depression and does not flow but rather distorts in shape enough to reach a ring-shaped second terminal which is spaced from and surrounds the mercury pool.

1 Claim, 4 Drawing Figures

DISTORTED-POOL MERCURY SWITCH

BACKGROUND OF THE INVENTION

1. Field of the Invention

This invention is in the field of electrical switching as controlled by the tilt angle of a switch body. It specifically concerns switches in which the moving element is a quantity of conductive liquid—normally metallic mercury. When the mercury has flowed to bridge an internal gap, because the switch is tilted appropriately, the switch conducts. In the untilted position switches of this sort are normally open.

2. Description of Prior Art

Most mercury tilt switches are built into an evacuated glass tube with electrodes penetrating the glass envelope. These switches have the advantages that they can be either normally-open or normally closed, and that fairly large currents can be handled by making the pool of mercury which moves bodily all at once-fairly large. They have several disadvantages also, a primary one being that they sense tilt only in one plane. Further, being glass they are inclined to break and so to contaminate their surroundings. Morrison in U.S. Pat. No. 2,713,159 shows a multidirectional mercury switch which makes contact between a base plate and a ring electrode. As shown his device requires quite a few parts with sealing contact between contact members and housing if the switch is to be sealed. It also depends on flow of the mercury over a surface, an effect I have found to be rather unreproducible and unreliable. Controlling the motion of mercury over surfaces is particularly hard when one is seeking to sense and react to small angles of tilt.

SUMMARY OF INVENTION

In a typical embodiment the terminals of the switch are made of soft steel or iron so as to be compatible with mercury—the conductive liquid. Contact from the electrical circuit to and from the switch is made at the terminals on the outside. The switch is sealed enclosing an anchored pool of mercury, which contacts only one terminal when the switch is horizontal. As the switch tilts, the pool of mercury tends to belly out on the lower side and to become shallower on the upper side. Thus it extends to a greater radius from the anchor point on the low side. When the radius is sufficient the pool touches the wall of a cavity in the upper, second terminal. Touching the wall closes the circuit, internal to the switch, between the two terminals. This occurs at an angle of tilt predetermined by the size of the pool of mercury, the gap between it and the second terminal wall, and the detailed shape of the anchoring means. The anchoring means typically is a recess in the first terminal located so part of the mercury must rest in it when the switch is either horizontal or tilted well past the switch-on angle.

When my typical switch is tilted still further, toward an inverted position, the mercury flows out of the anchoring recess and into the cavity of the second terminal. Thus the switch is off for very large tilt angles, when inverted. Re-erecting it causes the mercury to rest in the anchoring recess again, and the switch works as before.

An advantage of this construction is that the mercury need not wet the terminal. This reduces the angular hysteresis between turn-on and turn-off. Using the terminals both as contacts inside the switch and as attachment points for the external circuit outside the switch saves parts and cost. The insulating separator between the two terminals can also contain an anchoring hole for the mercury pool or a mounting shoulder to define "horizontal" also saving parts and cost. Whichever part contains the mounting shoulder is considered the body of the switch.

DETAILED DESCRIPTION

Figure 1:
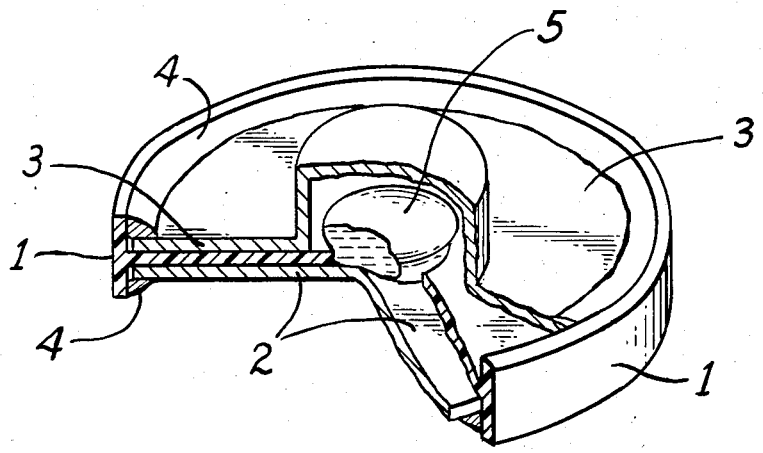
FIG. 1 is a cutaway perspective view of the preferred embodiment.

In FIG. 1, the invention is shown in perspective while the switch is resting horizontally. Item (5) is a pool of conductive liquid, mercury in the preferred embodiment, which is supported by a first or lower terminal (2). Pool of mercury (5) is held on lower terminal (2) by insulating separator (1), which covers the top surface of (2) except for a hole. This portion of the separator may be considered a circular central web, having in its center a hole the sidewalls of which will form a square-sided cavity whose bottom is closed by a portion of lower terminal (2). The tendency of the mercury to flow through the hole serves to hold the pool of mercury centered on the hole, which is blocked by lower terminal (2). Thus, the mercury pool rests in a concave depression having sidewalls and a bottom, of which the blocked hole as described is the preferred embodiment.

Upper terminal (3) contains on its underside a relatively deep cavity of such a diameter as to be larger than, and to fit over, pool of mercury (5). Upper terminal (3) rests on top of insulating separator (1) and is held against the separator by a bead of sealant (4), also called adhesive herein. A second bead of sealant (4) is used to fix and locate lower terminal (2) and separator (1). The sealant serves to keep the interior of the switch isolated from the environment so as to prolong switch life, as well as holding the parts together. Sealant is applied only at the rims of elements (2) and (3) so during its application there is no risk of contaminating the mercury.

In the embodiment shown in FIG. 1 the external rim portion of insulating separator 1 serves several purposes. It indicates when the switch is horizontal, it receives and locates both lower and upper terminal, and it provides easy control of the amount and positioning of sealant (4). The underneath portion of the rim guides and receives terminal (2); the upper portion guides and receives terminal (3). Terminal (3) is in cross section shaped generally like a hat, with a brim or rim portion in a horizontal plane in FIG. 1, with the crown or head-cavity portion opening to the bottom, and with the sidewalls of the cavity portion angled steeply as for example the 90° shown to the rim portion. The flat part at the top connecting the cavity wall is the top closure.

Figure 2:
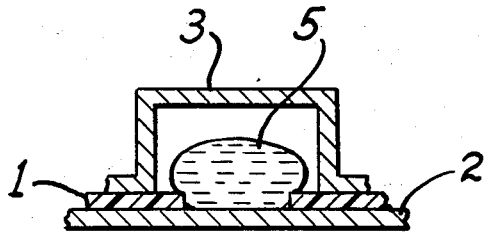
FIG. 2 is a sketch of the working parts including the pool of conductive liquid when the switch is horizontal.
Figure 3:
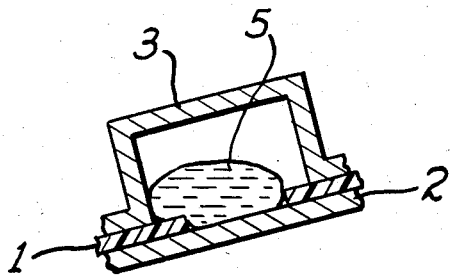
FIG. 3 is similar to FIG. 2, except the switch is tilted.

Operation of the invention is shown by comparing FIG. 2 with FIG. 3. Since terminals (2) and (3) and pool of conductive liquid (5) are all conductors and insulating spacer (1) is an insulator, the gap all around the uniformly bulged shape of (5) indicates (2) and (3) are electrically separate in FIG. 2. When the invention is tilted as in FIG. 3 the shape of (5) becomes unsymmetrical axially or bellied, and the belly portion extends far enough radially to touch the wall of the cavity in (3) making electrical contact and closing the switch. Touching the wall of the cavity to make electrical contact reflects the preferred embodiment; any conductive ring, surrounding mercury pool (5) and electrically connected to an external terminal, will serve as in internal terminal. Obviously, returning the switch somewhat toward the horizontal will cause the bellied portion of (5) to pull free of the wall and will open the switch. The difference between the "make" angle and the "break" angle is hysteresis, which is expected to be low at least in the preferred embodiment because mercury does not wet iron or low-carbon steel which is the material of terminals (2) and (3). Since mercury does not wet these materials it is expected that there will be only a small hysteresis as the switch is moved from open to closed and then back to open.

Figure 4:
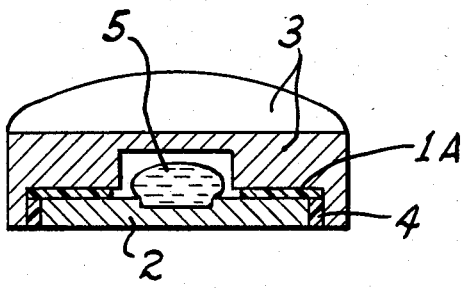
FIG. 4 is a half-section perspective view of an alternate embodiment.

FIG. 4 shows an alternate embodiment. The recess, depression, or shallow cavity which anchors the mercury is part of terminal (2). The electrical contacts from outside can both be made from one side of the switch in this design. Otherwise it is self-explanatory, functioning in the same way as has been previously described. Element 1A is an insulating washer isolating (2) and (3) electrically, and sealant (4) is also an insulator.

In all embodiments of this invention it will be necessary to control the size of recess anchoring (5), the size of (5), and the gap between (5) and (3) to establish the desired tilt angle for actuation. One of the advantages of this switch is its small size; the outer diameter of (1) can be made approximately one-half inch yet the switch will handle currents of tens of milliamperes.

Obviously the pool of conductive liquid is symmetrical about its center when the switch is not tilted. But the gap to the ring terminal (3) need not be constant—it can be made to vary with position around the pool if so desired.

The invention having been described in its preferred embodiment, it is clear that it is susceptible to numerous modifications and embodiments within the ability of those skilled in the art and without the exercise of the inventive faculty. Accordingly the scope of my invention is defined by the scope of the following claims.

I claim:

1. A multidirectional miniature mercury tilt switch with axial terminals, comprising:

a pool of mercury, and a disc-shaped lower terminal on which said pool of mercury rests when the switch is level, and an insulating separator having a first portion into which said disc-shaped lower terminal fits, a second portion into which an upper terminal fits, and a third portion comprising a circular central web of which the center is open, the open center being smaller in diameter than said pool of mercury and the central web portion covering the upper surface of said disc-shaped lower terminal except for the open center at which, due to the thickness of the central web portion, said pool of mercury rests, and said upper terminal shaped generally like a hat, having a rim portion and a head cavity portion, the outside of the rim portion fitting into said second portion of said insulating separator, the sidewall of the cavity portion being of slightly larger diameter than that which said pool of mercury has when the switch is not tilted, and the top closure being far enough above the rim, that is the cavity portion being of sufficient depth, to completely contain said pool of mercury when the switch is inverted, and sealing means to seal the rim portions of said upper terminal and said lower terminal to said insulating separator, whereby said pool of mercury distorts when the switch is tilted, touching the sidewall of the cavity in said upper terminal and closing the switch.

* * * * *